US005890630A

United States Patent [19]

Lobdell

[11] Patent Number: 5,890,630

[45] Date of Patent: Apr. 6, 1999

[54] DEVICE FOR DISPENSING FLOWABLE FOOD PRODUCTS

[76] Inventor: Raymond J. Lobdell, 360 Miner Street Rd., Canton, N.Y. 13617

[21] Appl. No.: 924,089

[22] Filed: Sep. 5, 1997

[51] Int. Cl.[6] ..... B65D 25/42

[52] U.S. Cl. ..... 222/192; 401/266; 401/139

[58] Field of Search ..... 222/192; 401/266, 401/139, 137; 30/123.3, 136

[56] References Cited

U.S. PATENT DOCUMENTS

| | | | |
|---|---|---|---|
| 2,716,251 | 8/1955 | Pearce | 15/136 |
| 2,772,432 | 12/1956 | Andreola | 401/139 |
| 2,930,063 | 3/1960 | Stull | 15/135 |
| 3,536,411 | 10/1970 | Eisert | 401/266 |
| 4,783,185 | 11/1988 | Erismann et al. | 401/37 |
| 4,922,859 | 5/1990 | Durell et al. | 119/83 |
| 4,946,081 | 8/1990 | Jacobson | 401/266 |
| 5,277,511 | 1/1994 | Stockton | 401/261 |
| 5,387,044 | 2/1995 | Accardo | 401/5 |

FOREIGN PATENT DOCUMENTS

| | | | |
|---|---|---|---|
| 2672273 | 8/1992 | France | 401/139 |

*Primary Examiner*—Steven O. Douglas
*Attorney, Agent, or Firm*—Norman B. Rainer

[57] ABSTRACT

A device for controllably dispensing a flowable food product from a squeezable container includes a blade elongated between a hollow base extremity and a distal extremity. The blade is bounded by opposed flat side surfaces and top and bottom edges. The bottom edge has an elongated slot opening. A channel communicates between the base and the elongated slot. A threaded bore in said base facilitates attachment to the exit opening of the container.

12 Claims, 2 Drawing Sheets

DEVICE FOR DISPENSING FLOWABLE FOOD PRODUCTS

BACKGROUND OF THE INVENTION

1. Field of the Invention

This invention concerns a device for dispensing a flowable food product from a container and controlling the placement of the dispensed product.

2. Description of the Prior Art

Numerous food products are available in flowable paste-like or viscous liquid forms, exemplary products including: margarine, butter, mayonnaise, honey, mustard, syrups, cheese formulations, peanut butter, ketchup, confectionery paste, and pureed products such as tomato paste and baby foods.

It is often difficult to remove and dispense the aforesaid food products from standard containers. Those products which are non-pourable are often packaged in wide mouth containers, requiring removal by the usual eating utensils. Such action often causes contamination of the product in the container and requires cleaning of the utensils. Products which are pourable can be packaged in narrow mouth containers. However, dripping and uncontrollable flow is often encountered, resulting in inaccurate placement of the food product, and necessitating cleaning of the exterior of the container.

The use of plastic squeeze containers is well established for the commercial packaging of flowable food products of relatively low viscosity or thin consistency such as mustard and ketchup. However, the squeeze containers are not effective with products of heavier consistency such as peanut butter. Also, the squeeze containers cannot provide a uniform thinly spread layer on a piece of bread. Although some squeeze containers employed for the commercial packaging of food products can be refilled by the user after all the original contents have been dispensed, such action will generally entail some effort and inconvenience. The general intent, however, of commercial squeeze containers for food products is that the container serves a one-time use as a storage container and dispensing device.

Applicator devices for dispensing barely flowable substances such as toothpaste, adhesive, caulking, grease and other paste-like substances have earlier been disclosed comprised of a squeezable container equipped with removable closure means adapted to spread or otherwise direct the placement of the extruded material. Typical of such devices are those disclosed in U.S. Pat. No. 2,716,251 to Pearce, U.S. Pat. No. 2,930,063 to Stull, and U.S. Pat. No. 5,387,044 to Accardo. The aforesaid applicator devices are designed to dispense material in a continuous straight line path in the axial direction of movement of the device. None are specifically designed to spread dispensed material in reciprocal strokes transverse to the axis of the device.

It is accordingly and object of the present invention to provide a device for controllably dispensing a flowable food product from a squeeze container.

It is another object of this invention to provide a device as in the foregoing object which is removably associated with said container.

It is yet another object of this invention to provide a device of the aforesaid nature of streamlined construction which facilitates cleaning and re-use.

It is a further object of the present invention to provide a device of the aforesaid nature to facilitate the spreading of a flowable food product in a path transverse to the direction of emergence of said food product from a squeezable container.

It is a still further object of this invention to provide a device of the aforesaid nature of monolithic construction amenable to low cost manufacture.

It is an additional object of the present invention to provide apparatus for storing and dispensing a flowable food product.

These objects and other objects and advantages of the invention will be apparent from the following description.

SUMMARY OF THE INVENTION

The above and other beneficial objects and advantages are accomplished in accordance with the present invention by a device for controllably dispensing a flowable food product from the opening of a squeezable container, said device comprising:

a) a blade of monolithic plastic construction elongated between a hollow base extremity and distal extremity and bounded in part by opposed flat side surfaces and top and bottom edges, b) a channel communicating between said hollow base extremity and said bottom edge, and c) attachment means associated with said base extremity for removably securing said device to the opening of said container.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
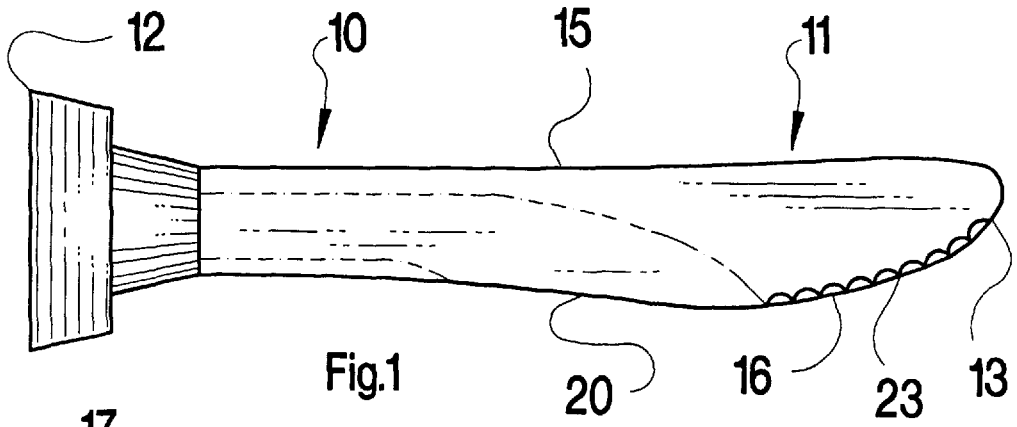
FIG. 1 is a side view of an embodiment of the device of the present invention.
Figure 2:
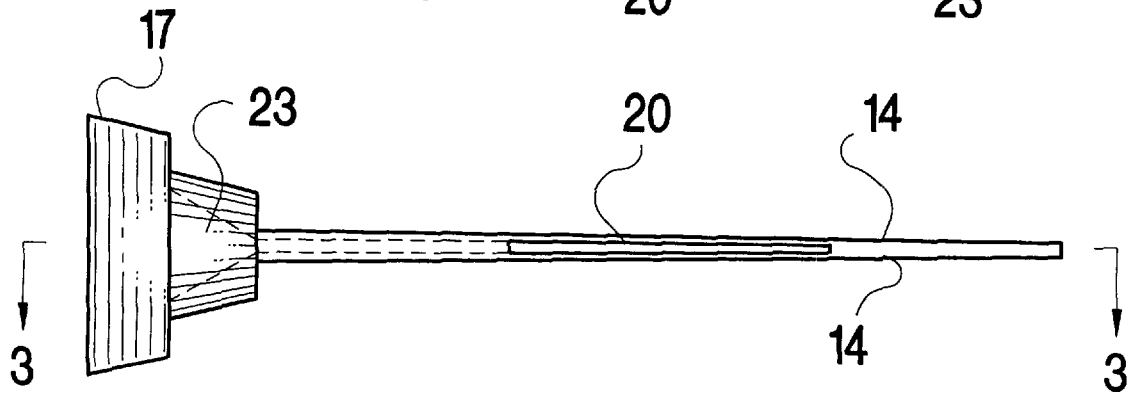
FIG. 2 is a bottom view of the device of FIG. 1.
Figure 3:
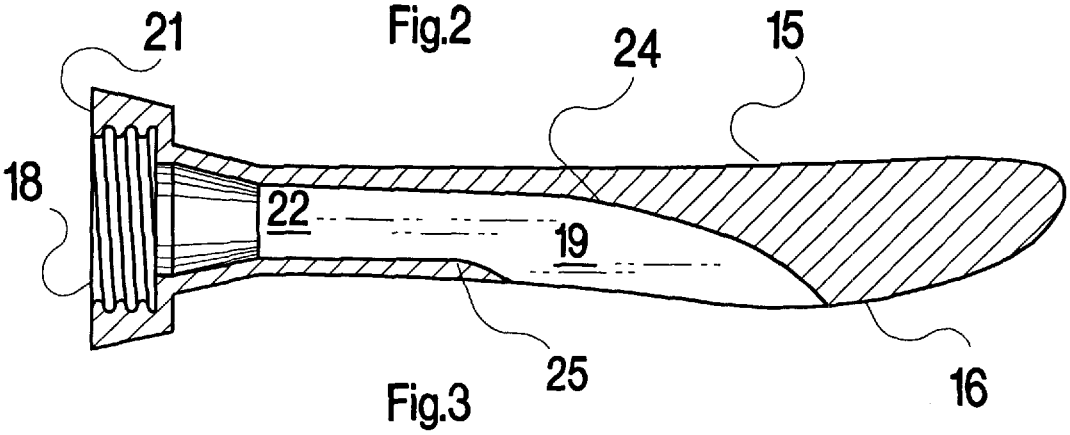
FIG. 3 is a sectional view taken in the direction of the arrows upon the line 3—3 of FIG. 2.
Figure 4:
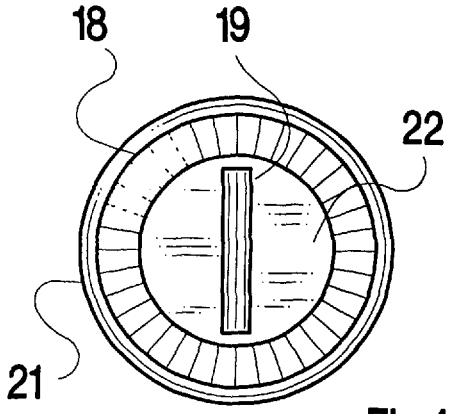
FIG. 4 is a base end view taken from the left of FIG. 1.
Figure 5:
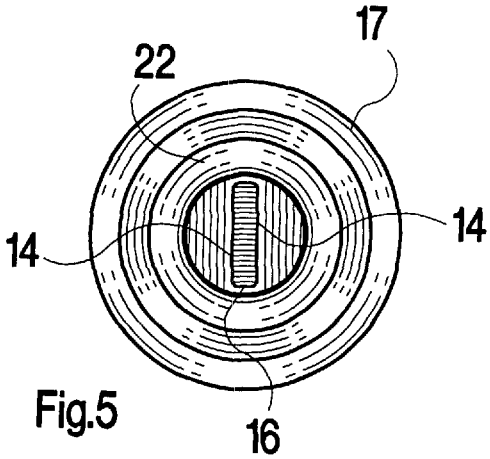
FIG. 5 is a distal end view taken from the right of FIG. 1.

Referring now to FIGS. 1–5, an embodiment of the dispensing device 10 of the present invention is shown comprised of blade 11 of monolithic plastic construction elongated between hollow base extremity 12 and rounded distal extremity 13. The blade is further bounded by opposed flat side surfaces 14 and top and bottom edges 15 and 16, respectively. Top edge 15 is preferably straight, and bottom edge 16 is preferably arcuately shaped and concave with respect to said top edge. Side surfaces 14 are preferably convergent in going from top edge 15 to bottom edge 16, causing the cross-sectional contour of the blade to be wedge-shaped, whereby said top edge is wider than said bottom edge.

Base extremity 12 is comprised of a circular shoulder 17 having an interior threaded bore 18 disposed in coaxial relationship with shoulder 17. A flat annular abutment face 21 is disposed around base 18. A channel 19 communicates between said bore 18 and bottom edge 16, terminating in an elongated slot opening 20. A convergent transition 22 may be interposed between bore 18 and channel 19 to expedite streamlined flow of the food products.

The overall length of the dispenser device, measured between abutment face 21 and distal extremity 13 may range between about 5 ½ and 7 inches. The device may further be characterized in having an axis of elongation coincident with section line 3—3 of FIG. 2 and a plane of symmetry that contains said axis in parallel disposition between said side surfaces.

Bottom edge 16, forwardly of slot opening 20 and adjacent distal extremity 13, may be provided with a series of serrations 23 which facilitate the cutting of bread and toasted bread. The length of slot opening 20 is preferably between 40% and 60% of the overall length of bottom edge 16. Channel 19 is of flat rectangular cross-sectional contour, bounded in part by upper and lower downwardly directed arcuate surfaces 24 and 25, respectively. Accordingly, it is seen that, whereas channel 19 has a small cross-sectional area where it originates at base 18, it has a considerably larger cross-sectional area where it terminates at slot opening 20. The increase in said cross-sectional area of channel 19 is preferably in the range of 100% to 350%. Because of such specialized dimensional relationships, flowable food material which enters base 18 can be smoothly and evenly distributed over a relatively large surface, such as a piece of bread. Application of the food product is preferably accomplished by strokes taken back and forth transversely to said plane of symmetry. The food product emergent from slot opening 20 is physically distributed in thin layers by virtue of bottom edge 16.

Figure 6:
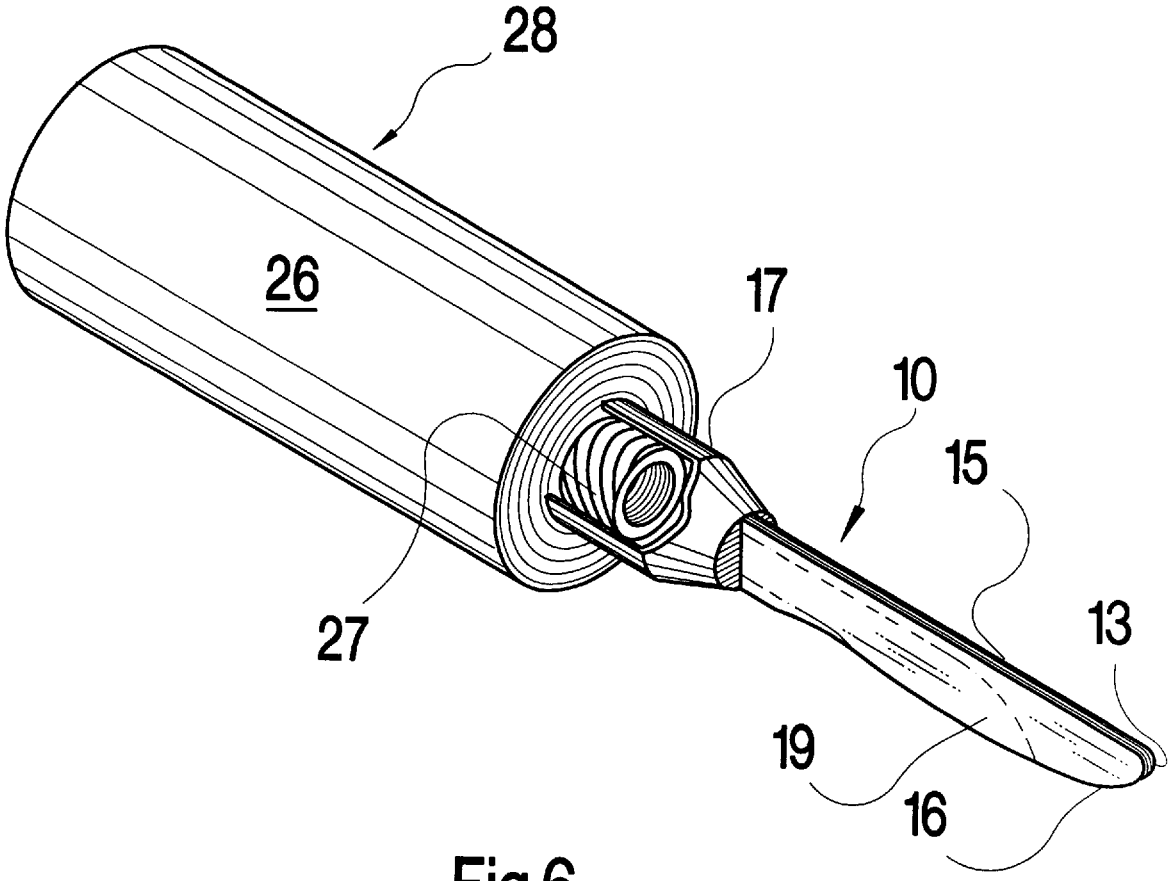
FIG. 6 is a perspective view of the device of FIG. 1 shown in combination with a squeezable dispensing container, portions being broken away to reveal interior details.

FIG. 6 illustrates an embodiment of the apparatus 28 of this invention, comprising a squeezable food container 26 having an exit opening equipped with a threaded male collar 27, and the dispenser device 10 threadably engaged with said collar.

The dispenser device 10 may also be equipped with a removable protective sheath to facilitate sanitary storage of the apparatus 28 upright on a shelf such as in a refrigerator.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A device for controllably dispensing a flowable food product from an opening of a squeezeable container, said device being of monolithic construction, fabricated of plastic, and comprising:

a) a blade elongated between a hollow base extremity and a distal extremity and bounded by opposed flat side surfaces, a straight top edge and a bottom edge which is arcuately shaped and concave with respect to said top edge, said bottom edge having an elongated slot opening, b) a channel communicating between said hollow base extremity and said slot opening, and c) attachment means associated with said base extremity for removable securing said device to the opening of said container.

2. The device of claim 1 wherein said top edge is wider than said bottom edge.

3. The device of claim 2 wherein said side surfaces are convergent in going from said top edge to said bottom edge, causing the cross-sectional contour of said blade to be wedge-shaped.

4. The device of claim 1 wherein said base extremity is comprised of a circular shoulder having an interior threaded bore disposed in coaxial relationship with said shoulder.

5. The device of claim 4 having a flat annular abutment face disposed around said base.

6. The device of claim 4 having a convergent transition zone interposed between said bore and channel.

7. The device of claim 1 wherein said bottom edge has a length that extends between said base and said distal extremity.

8. The device of claim 7 wherein the length of said slot opening is between 40% and 60% of the length of said bottom edge.

9. The device of claim 1 wherein said channel is of flat rectangular cross-sectional contour, bounded in part by upper and lower downwardly directed arcuate surfaces.

10. The device of claim 1 wherein said channel has a smaller cross-sectional area where it originates at said base than the cross-sectional area where it terminates in said slot opening.

11. The device of claim 10 wherein the increase in the cross-sectional area of said channel in going from said base to said slot opening is between 100% and 350%.

12. A device for controllably dispensing a flowable food product from an opening of a squeezeable container, said device comprising:

a) a blade elongated between a hollow base extremity and a distal extremity and bounded by opposed flat side surfaces and top and bottom edges, said bottom edge having an elongated slot opening and a series of serrations which facilitates the cutting of bread, b) a channel communicating between said hollow base extremity and said slot opening, and c) attachment means associated with said base extremity for removably securing said device to the opening of said container.

* * * * *